US009741223B2

(12) United States Patent
Dodson

(10) Patent No.: US 9,741,223 B2
(45) **Date of Patent: *Aug. 22, 2017**

(54) AUTOMATED SECURITY SYSTEM FOR SCHOOLS AND OTHER STRUCTURES

(71) Applicant: S.H.I.E.L.D., LLC, Carrollton, GA (US)

(72) Inventor: Patrick Craig Dodson, Carrollton, GA (US)

(73) Assignee: S.H.I.E.L.D., LLC, Carrollton, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/269,244

(22) Filed: Sep. 19, 2016

(65) Prior Publication Data

US 2017/0004694 A1 Jan. 5, 2017

Related U.S. Application Data

(63) Continuation-in-part of application No. 14/258,790, filed on Apr. 22, 2014, now Pat. No. 9,449,490.

(60) Provisional application No. 61/815,017, filed on Apr. 23, 2013.

(51) Int. Cl.

| | |
|---|---|
| ***G08B 19/00*** | (2006.01) |
| ***G08B 21/02*** | (2006.01) |
| ***G08B 13/24*** | (2006.01) |
| ***G08B 5/36*** | (2006.01) |
| ***G08B 3/10*** | (2006.01) |
| ***G08B 25/00*** | (2006.01) |

(52) U.S. Cl.

CPC ..... *G08B 21/02* (2013.01); *G08B 3/10* (2013.01); *G08B 5/36* (2013.01); *G08B 13/2491* (2013.01); *G08B 25/006* (2013.01)

(58) Field of Classification Search

CPC . G08B 21/02; G08B 3/10; G08B 5/36; G08B 13/2491

USPC ..... 340/521

See application file for complete search history.

(56) References Cited

U.S. PATENT DOCUMENTS

| | | | | |
|---|---|---|---|---|
| 8,922,657 | B2 | 12/2014 | Calman et al. | |
| 9,449,490 | B2 * | 9/2016 | Dodson | G08B 25/006 |
| 2003/0023874 | A1 * | 1/2003 | Prokupets | G06F 21/32 726/4 |
| 2006/0092011 | A1 * | 5/2006 | Simon | G08B 13/19682 340/521 |
| 2007/0080806 | A1 * | 4/2007 | Lax | E05B 73/0017 340/572.1 |

(Continued)

*Primary Examiner* — Kerri McNally

(74) *Attorney, Agent, or Firm* — Thomas | Horstemeyer, LLP

(57) ABSTRACT

Disclosed are various embodiments for security systems for schools and similar structures. Various security devices may be monitored in a structure, such as a school, where at least one of the security devices includes a wall-mounted duress alarm, an electronic keypad, a radio-frequency identification (RFID) reader, a card access reader, a decibel meter, a smoke detector, or a mobile computing device. In response to a signal from one of the security devices being indicative of a breach having occurred in the structure, a predetermined breach policy may be automatically implemented that may include, for example, compartmentalizing a region of the structure by performing an automated closing of a door that separates the region of the structure from another region of the structure.

20 Claims, 11 Drawing Sheets

(56) References Cited

U.S. PATENT DOCUMENTS

| | | | | |
|---|---|---|---|---|
| 2008/0252451 | A1 | 10/2008 | Buchhalter | |
| 2010/0188234 | A1 | 7/2010 | Farley et al. | |
| 2012/0249311 | A1* | 10/2012 | Varieur | G08B 17/02 340/287 |

* cited by examiner

209a

209b

209c

AUTOMATED SECURITY SYSTEM FOR SCHOOLS AND OTHER STRUCTURES

CROSS-REFERENCE TO RELATED APPLICATIONS

This application in a continuation-in-part of U.S. patent application Ser. No. 14/258,790 entitled "AUTOMATED SECURITY SYSTEM FOR STRUCTURES," filed on Apr. 22, 2014, now issued as U.S. Pat. No. 9,449,490 which claims the benefit of and priority to U.S. Provisional Patent Application No. 61/815,017 entitled "AUTOMATED SECURITY SYSTEM FOR STRUCTURES," filed on Apr. 23, 2013, the contents of both of which are incorporated by reference in their entirety herein.

BACKGROUND

Security breaches of structures such as schools, hospitals, office buildings, and government buildings are regretfully a common occurrence worldwide. For example, persons carrying harmful weapons or explosive devices have infiltrated schools, colleges, hospitals, and workspaces to inflict bodily harm on the persons within the structure. Such security breaches can result in harm and substantial bodily injury to the occupants. Generally, when a breach of a structure occurs, response time is critical in the prevention of harm or substantial bodily injury.

BRIEF SUMMARY OF THE INVENTION

Various embodiments for security systems for schools, hospitals, office buildings, government buildings, and other structures are described. In one embodiment, a security system includes a multitude of security devices in communication through a network implemented in a structure, such as a school. At least one of the plurality of security devices includes, for example, a wall-mounted duress alarm, an electronic keypad, a radio-frequency identification (RFID) reader, a card access reader, a decibel meter, a smoke detector, and a mobile computing device. Processing circuitry may be configured to monitor the security devices over the network and identify a signal from one of the security devices indicative that a breach has occurred in a region of the structure. In response to the signal being identified, a predetermined breach policy may be automatically implemented.

The predetermined breach policy may include, for example, compartmentalizing the region of the structure by performing an automated closing of a door that separates the region of the structure from another region of the structure, causing a light emitting device to emit a pulsating light, causing a noise emitting device to emit a noise at a predefined decibel range, notifying emergency personnel over an emergency channel, and/or other event described herein.

In further embodiments, the school security system may include a first wall-mounted duress alarm and a second wall-mounted duress alarm being a color different than the first wall-mounted duress alarm, where the processing circuitry is configured to implement a first level of breach policy in response to the first wall-mounted duress alarm being pressed, or implement a second level of breach policy in response to the second wall-mounted duress alarm being pressed, where the second level of breach policy is different than the first level of breach policy.

Performing the automated closing of the door that separates the region of the structure from another region of the structure may include disengaging a first magnet through the network that causes the door, situated in an open position, to close, and engaging a second magnet through the network that causes the door to lock in a closed position. Alternatively, performing the automated closing of the door that separates the region of the structure from another region of the structure may include causing an actuator to lower an overhead-mounted door from an open position to a closed position.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

The present disclosure relates to an automated security system for schools and other structures. Security breaches of structures such as schools, hospitals, office buildings, and government buildings are regretfully a common occurrence worldwide. For example, persons carrying harmful weapons or explosive devices have infiltrated schools, colleges, hospitals, and workspaces to inflict bodily harm on the persons within the structure. Such security breaches can result in harm and substantial bodily injury to the occupants. Generally, when a breach of a structure occurs, response time is critical in the prevention of harm or substantial bodily injury.

Accordingly, it is beneficial to have an automated system capable of providing security to a structure, such as a school, office building, government building, or similar structure. According to various embodiments, a network of security devices may be accessed and/or controlled by one or more monitoring devices, wherein each of the one or more monitoring devices are configured to monitor one or more signals emitted by one or more security devices. In response to a signal received from at least one of the security devices indicating a breach of the structure, a compartmentalization of the structure may be initiated, where the compartmentalization may include, for example, performing a lockdown of the structure utilizing at least one of the one or more security devices. If a compartmentalization of the structure has been initiated, various notifications may be sent to administrative and emergency personnel over suitable communication channels, such as a radio frequency for first responders or by dialing 9-1-1. In the following discussion, a general description of the automated security system and its components is provided, followed by a discussion of the operation of the same.

Figure 1:
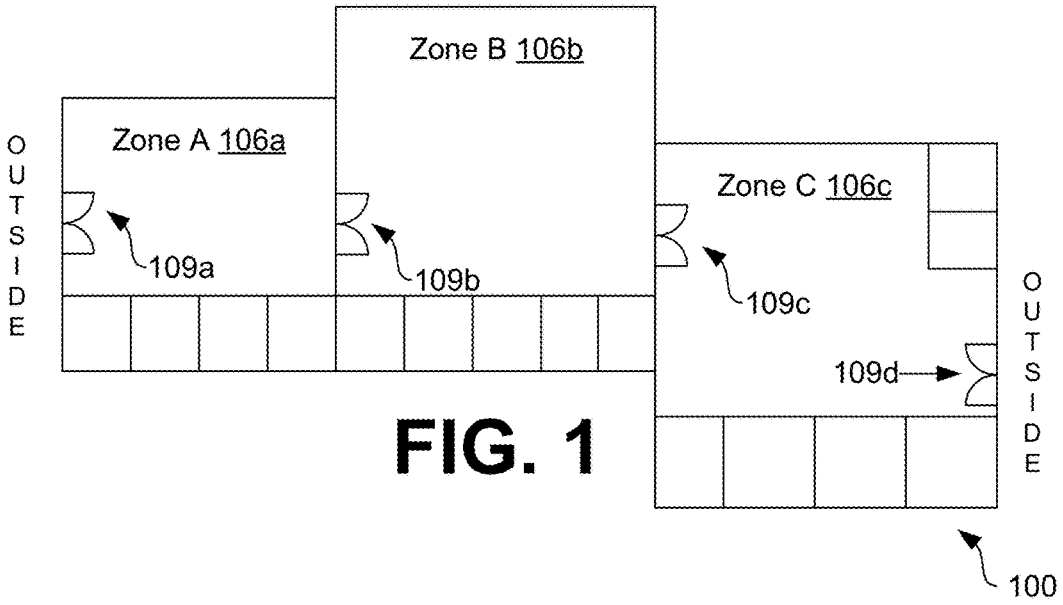
FIG. 1 is a drawing of a floor plan of a structure according to various embodiments of the present disclosure.

With reference to FIG. 1, shown is a drawing of an example of a floor plan that can correspond to a structure 100, such as a home, school, government building, or like structure. As can be appreciated, the structure 100 may be divided into one or more portions or zones. As depicted in the floor plan of FIG. 1, the structure 100 is divided into zone A 106*a*, zone B 106*b*, and zone C 106*c* (collectively "zones 106"). Access to the one or more zones 106 may be controlled via one or more portals or entryways, such as doorways 109, windows, or any other type of entrance or exit, as may be appreciated. For example, doorway 109*a* and doorway 109*d* provide access from the exterior of the building to the interior of the building, and vice versa. Similarly, doorway 109*b* and doorway 109*c* may facilitate access to the different portions of the structure.

It may be beneficial, for example, to compartmentalize portions of the structure 100 to prevent an intruder from accessing different portions of the structure 100, or to protect children, employees, valuables, or other objects located in a safe portion of the structure 100. For example, by controlling one or more doorways 109, access to certain portions of the structure 100 may be restricted upon detection of a breach. Accordingly, a system that controls access to the zones of a structure 100 may prevent an intruder from accessing subsequent portions of the structure 100. As a result, the threat of bodily harm to occupants within or outside compartmentalized regions may be substantially reduced or eliminated.

Figure 2:
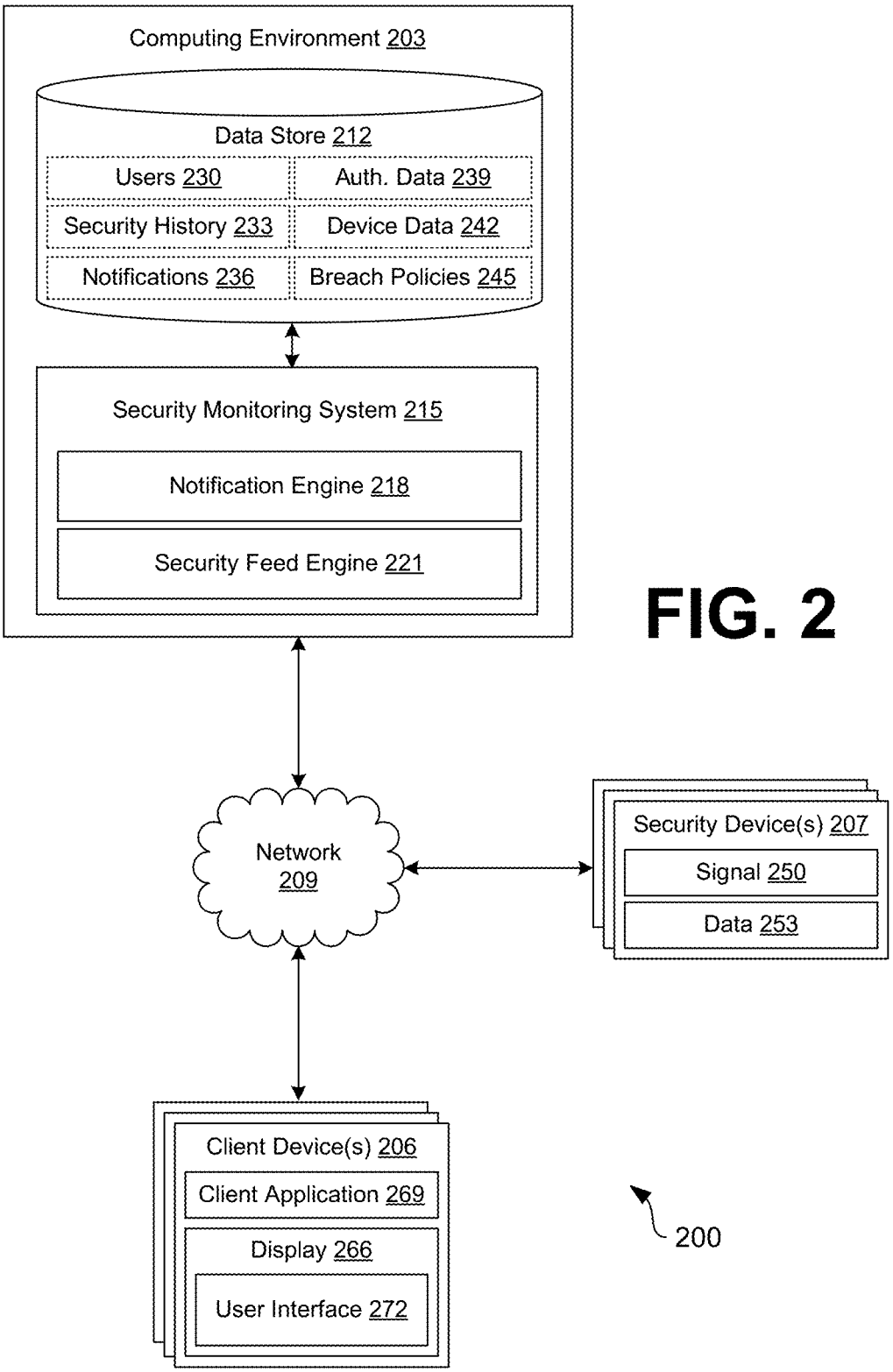
FIG. 2 is a drawing of a networked environment according to various embodiments of the present disclosure.

With reference to FIG. 2, shown is a networked environment 200 that may be used to monitor one or more security devices according to various embodiments of the present disclosure. The networked environment 200 includes a computing environment 203, a client device 206, one or more security devices 207, and potentially other devices that are in data communication with each other via a network 209. The network 209 includes, for example, the Internet, intranets, extranets, wide area networks (WANs), local area networks (LANs), wired networks, wireless networks, or other suitable networks, etc., or any combination of two or more such networks.

The computing environment 203 may comprise, for example, a server computer or any other system providing computing capability. Alternatively, the computing environment 203 may employ a plurality of computing devices that are arranged, for example, in one or more server banks or computer banks or other arrangements. Such computing devices may be located in a single installation or may be distributed among many different geographical locations. For example, the computing environment 203 may include a plurality of computing devices that together may comprise a cloud computing resource, a grid computing resource, and/or any other distributed computing arrangement. In some cases, the computing environment 203 may correspond to an elastic computing resource where the allotted capacity of processing, network, storage, or other computing-related resources may vary over time.

Various applications and other functionality may be executed in the computing environment 203 according to various embodiments. Also, various data is stored in a data store 212 that is accessible to the computing environment 203. The data store 212 may be representative of a plurality of data stores 212 as can be appreciated. The data stored in the data store 212, for example, is associated with the operation of the various applications and/or functional entities described below.

The components executed in the computing environment 203, for example, include a security monitoring system 215, a notification engine 218, a security feed engine 221, and other applications, services, processes, systems, engines, or functionality. The security monitoring system 215, configuring the computing environment 203 to act as a monitoring device, is executed to monitor signals and data communicated by one or more security devices 207 over the network 209. Monitoring the security device 207 may include, for example, periodically or constantly receiving and processing a signal or data from each of a plurality of security devices 207 over the network 209 implemented in a structure. Further, the security monitoring system 215 is executed to conduct certain events if at least one of the one or more security devices 207 indicates the occurrence of a breach of a structure 100, as will be discussed in greater detail below.

The notification engine 218 is executed to send a notification to one or more services and/or personnel in the event that a breach of a structure has occurred, e.g., to the personnel using a notification set forth in a breach policy 245. For example, a decibel meter may produce a signal in the event a noise in a structure has reached a threshold level (e.g., the threshold level corresponding to the sound level produced by gunshot). The notification engine 218 may transmit information associated with the detecting device (e.g., the decibel reading obtained from a decibel meter that is detects a source of a noise such as an explosion or gunshot, a location of the detecting device, etc.), whether other security devices 207 have indicated a breach, and/or other information to a security monitoring center, a police department, a fire department, personnel associated with the structure (e.g., principals, teachers, doctors, patients), and/or any other personnel.

The information transmitted by the notification engine 218 may comprise, for example, a type of device that has indicated a breach, a location of the device, a map comprising the location of the device, etc. According to various embodiments, the notification may be transmitted in the form of an audio sound communicated over an emergency channel (e.g., police channel). To this end, the notification engine 218 may communicate with a radio capable of extraneous communication over the emergency channel over a suitable radio frequency. In further embodiments, the notification engine 218 may automatically dial 9-1-1, a telephone number associated with medical or police responders, or other appropriate number.

The security feed engine 221 is executed to communicate with one or more security devices 207 capable of providing audio or visual data of events occurring within or around a structure. For example, one or more security devices 207 in the network 209 may comprise, for example, Internet Protocol (IP) cameras. The security feed engine 221 may be used to communicate audio and/or video data received from the IP cameras and provide the audio and/or video data to other systems and/or devices capable of observing the audio and/or video data. In various embodiments, the audio and/or video data may be monitored by an agent in a security monitoring center. In another embodiment, in the event that a breach has been detected, audio and/or video data may be provided in a feed accessible by one or more client devices 206. For example, if a breach has occurred in a school structure, a teacher, a police officer, a fireman, etc., may access feeds of audio and/or video data produced by a security device 207 using his or her smartphone, tablet computer, personal computer, or any other type of computing device capable of accessing an audio and/or video feed.

The data stored in the data store 212 includes, for example, data associated with users 230 of the security monitoring system 215. Further, the data stored in the data store 212 includes, for example, but not limited to, security history 233, notifications 236, authentication data 239, device data 242, breach policies 245, and potentially other data. The users 230 may comprise, for example, persons having access to the security monitoring system 215, the notification engine 218, the security feed engine 221, and/or data stored in data store 212. Security history 233 may comprise, for example, information (e.g., audio data, video data, etc.) provided by one or more of the security devices 207. Notifications 236 may comprise, for example, predefined or customized messages that may be transmitted by the notification engine 218 to external services (e.g., security monitoring centers, police departments, fire departments, etc.) and/or dynamically generated notifications created responsive to a breach. For example, dynamically generated notifications may comprise a type of a security device 207 that has indicated a breach as well as a location of the security device 207.

Authentication data 239 may comprise, for example, data that may be used by users of the automated security system to enable and/or disable the system. For example, upon an initiation of a compartmentalization of a structure, an authorized user (e.g., first responder, security personnel, etc.) may use authentication data 239 (provided via a badge, a pin number, and/or any other similar component) to disable the compartmentalization, thereby permitting access to the structure 100. Device data 242 may comprise, for example, information associated with one or more client devices 206 that may be used to authenticate a user and/or access the security monitoring system 215, the notification engine 218, the security feed engine 221, the data stored in the data store 212, and/or any like component.

The breach policies 245 may comprise, for example, a predefined order of events to be automatically performed in the event that an indication of a breach of a structure 100 has been detected by one or more security devices 207 and/or monitoring devices. As a non-limiting example, in the event that a breach of a structure 100 has been detected by one or more security devices 207, a monitoring device (e.g., computing environment 203) may initiate a compartmentalization of the structure 100 according to a breach policy 245. The breach policy 245 may also indicate that first responders are to be notified of the breach via one or more mediums of communication. Further, the breach policy 245 may define that other security devices are to be employed (e.g., cameras, sirens, flashing lights, etc.), as will be discussed in greater detail below. Additionally, the breach policy 245 may define that the compartmentalization is to remain until an authorized user (authenticated via authentication data 239) disables the compartmentalization.

The client device 206 is representative of a plurality of client devices 206 that may be coupled to the network 209. The client device 206 may comprise, for example, a processor-based system such as a computer system. Such a computer system may be embodied in the form of a desktop computer, a laptop computer, personal digital assistants, cellular telephones, smartphones, set-top boxes, music players, web pads, tablet computer systems, game consoles, electronic book readers, or other devices with like capability. The client device 206 may include a display 266. The display 266 may comprise, for example, one or more devices such as liquid crystal display (LCD) displays, gas plasma-based flat panel displays, organic light emitting diode (OLED) displays, LCD projectors, or other types of display devices.

The client device 206 may be configured to execute various applications such as a client application 269 and/or other applications. The client application 269 may be executed in a client device 206, for example, to access network content served up by the computing environment 203 and/or other servers, thereby rendering a user interface 272 on the display 266. To this end, the client application 269 may comprise, for example, a browser or a dedicated application, and the user interface 272 may comprise a network page, an application screen, etc. The client device 206 may be configured to execute applications beyond the client application 269 such as, for example, email applications, social networking applications, word processors, spreadsheets, and/or other applications.

The security devices 207 may comprise, for example, cameras, noise emitting devices, light emitting devices, noise detection devices, automated door closing systems, door alarms, alarm buttons, telephones, smoke detection devices, access power controllers, keypads, card access readers, radio-frequency identification (RFID) readers, and/or other security devices 207 configured to emit one or more signals in the event that an indication of a breach of the structure 100 has been detected. As can be appreciated, the security devices 207 may be strategically placed internal and/or external to a structure 100 and may communicate over network 209 to transmit and/or receive signals 250 and/or data 253.

Next, a general description of the operation of the various components of the networked environment 200 is provided. To begin, one or more security devices 207 (e.g., cameras, noise emitting devices, light emitting devices, noise detection devices, automated door closing systems, door alarms, alarm buttons, telephones, access power controllers, keypads, card access readers, biometric scanners, or RFID readers) may be installed in a structure 100 such that communication with at least one monitoring device over the network 209 is enabled. Monitoring the security device 207 may include, for example, periodically or constantly receiving and processing the signal 250 from each of a plurality of security devices 207 in the network 209 implemented in the structure 100. According to various embodiments, the security device 207 may monitor actions in an environment and send a signal 250 over the network to other security devices 207 in the event that, for example, an indication of a breach of the structure 100 has been detected. For example, the security device 207 may comprise a noise emitting device configured to emit a signal 250 in the event that a sound has reached a threshold of a firearm or an explosive device.

A monitoring device, such as the computing environment 203, may translate or otherwise interpret the signal 250. In the event that an indication of a breach is detected by one or more security devices 207, one or more breach events associated with one or more breach policies 245 may be initiated. For example, a breach policy 245 may be predefined by an administrator such that doors, windows, or other portals that facilitate access from one zone 106 of the structure 100 to another zone 106 of the structure 100 are to be closed by employing an automated door closing mechanism, as will be discussed in greater detail below with respect to FIGS. 5A-D. Moreover, additional security measures associated with the breach policy 245 may be initiated. For example, a security company, a police department, a fire department, and/or any other personnel may be notified of the breach as well as information associated with the security devices 207 that indicates a breach has occurred. In one embodiment, a breach policy 245 may initiate certain sounds, lights, or voice instructions. Any one or more of these events (e.g., closings, notifications, and other initiations of security measures) may be used alone or in any combination in various embodiments of a breach policy 245.

According to various embodiments, a breach policy 245 may comprise one or more levels of breach events. Each of the levels may correspond to a priority that may indicate a threat level of the breach. To this end, the levels of breach events may correspond to a type of security device 207 indicating that a breach has occurred. For example, duress alarms may be placed throughout a school or government building. As can be appreciated, children may frequently engage a duress alarm as a prank or as an accident. A compartmentalization may not be necessary every time a child has engaged the duress alarm. Accordingly, a lower level of breach event may comprise sending a notification to administrative personnel that the duress alarm has been engaged as well as the location of the duress alarm. However, a noise detection device may not engage unless a noise has been emitted at a threshold level, such as that of a gunshot, a human scream, or an explosion. The noise detection device may be associated with a higher level of breach event such that the structure 100 is compartmentalized and emergency personnel are notified.

Security devices 207 may further comprise devices capable of recording audio and/or video. Accordingly, feeds may be made available to various authenticated personnel such as first responders, teachers, administrators, etc. While the structure 100 is being compartmentalized and personnel is being notified, the structure may continue to be monitored.

A breach policy 245, such as a compartmentalization of a structure 100 using an automated door closing mechanism, may be terminated by via a security device 207 capable of authenticating personnel. For example, a keypad, card access reader, and/or RFID reader may be configured to grant access to one or more portions of the structure 100, thereby terminating the breach policy 245, as will be discussed in greater detail below. Similarly, a smoke detection device may be configured to grant access to one or more portions of the structure 100 in the event a certain threshold of smoke is detected (e.g., indicating the presence of fire).

Figure 3A:
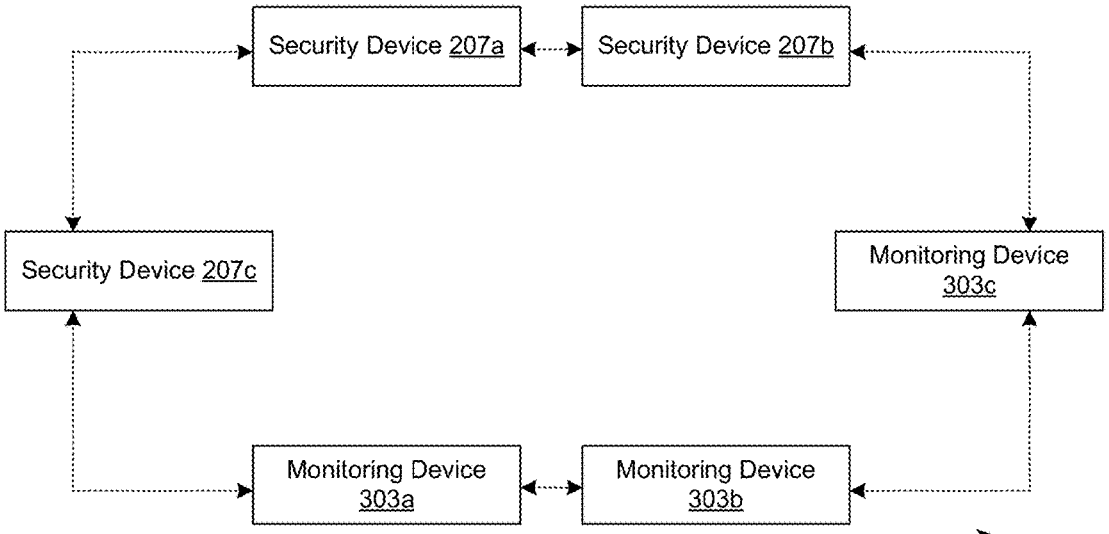
FIGS. 3A-3C are drawings of various network arrangements according to various embodiments of the present disclosure.

Referring next to FIG. 3A, shown is an embodiment of an arrangement of a network 209*a* that may be employed by a security monitoring system 215 and/or like system according to various embodiments. A security system may comprise, for example, one or more security devices 207 in communication with at least one monitoring device 303 over the network 209. As discussed above, the network 209 may comprise, for example, the Internet, intranets, extranets, wide area networks (WANs), local area networks (LANs), wired networks (low voltage, extra-low voltage, high voltage, etc.), wireless networks, or other suitable networks, etc., or any combination of two or more such networks.

The security devices 207 may comprise, for example, cameras, noise emitting devices, light emitting devices, noise detection devices, smoke detection devices, automated door closing systems, door alarms, alarm buttons, telephones, access power controllers, keypads, card access readers, RFID readers, and/or other security devices 207. As can be appreciated, the security devices 207 may be strategically placed internal and/or external to a structure 100. Cameras may comprise, for example, internet protocol (IP) cameras or Pan-Tilt-Zoom cameras that may be used in monitoring the various areas of the structure 100 by providing audio and/or video feeds. Noise emitting devices may comprise, for example, sirens or alarms, which may be used to notify those in or around a structure 100 that a breach has occurred. Moreover, a noise emitting device may be used to disorient and/or distract an intruder. For example, a police siren may be emulated through a noise emitting device, giving an intruder an illusion (whether supraliminal or subliminal) that police are within the structure 100 and/or have been notified.

Light emitting devices may comprise, for example, strobe lights, flood lights, and/or other light emitting devices that may be used to notify those in or around a structure 100 that a breach has occurred. Similar to a noise emitting device, a light emitting device may be used to disorient and/or distract an intruder. For example, a light emitting device may be disabled to reduce vision. In another embodiment, a strobe light may be used to disorient an intruder. In this embodiment, a flashing light (e.g., pulsating red light, pulsating blue light, etc.) may be employed by a light emitting device to give an intruder an allusion (whether supraliminal or subliminal) that police are within the structure 100 and/or have been notified.

Automated door closing systems may be employed to facilitate the compartmentalization of a structure 100. As shown in FIG. 1, a structure 100 may comprise one or more portions accessible by one or more doorways. By controlling the doorways, access to other portions of the structure 100 by an intruder may be inhibited and/or eliminated. Moreover, people in other portions of the structure 100 may be protected. Accordingly, an automated door closing system may be employed to automatically close doors, thus compartmentalizing the structure 100 into one or more portions. The compartmentalization of the structure 100 may be accomplished according to the predefined breach policy 245 which may be configured by an administrator to be consistent with fire codes and/or other structure safety norms.

As discussed above, various noise detection devices may be employed in the detection of a breach of a structure 100. For example, a noise detecting device may comprise a decibel meter that may detect noises in the decibel range of a gunshot, a human scream, an explosion, etc. Accordingly, upon a detection of a noise in a predefined decibel range, an initiation of a breach policy 245 may be initiated and/or a compartmentalization of the system may automatically be initiated.

Similarly, devices facilitating the implementation of a breach policy 245 may be initiated manually by persons within or external to a structure 100. For example, door alarms, alarm buttons, telephones, keypads, card access readers, RFID readers, and/or other security devices 207 may be used to manually initiate a breach policy 245. In various embodiments, alarm buttons may be strategically placed throughout the structure 100. Upon an engagement of the alarm button by a person (e.g., a user pressing the alarm button with his or her hand), a breach policy 245 may be initiated. Similarly, a telephone may be configured to initiate a breach policy 245 upon receipt of a predefined numeric sequence (e.g., a telephone number). As may be appreciated, other devices may be used to initiate a breach policy 245.

Further, keypads, card access readers, and/or RFID readers may be placed throughout a structure 100. The keypads may be configured to grant access to various portions of the structure 100 using a predefined number sequence that authenticates a person attempting to gain access to the various portions of the structure 100. For example, a predefined number sequence may be given to first responders. Upon entering the predefined number sequence on the keypad, the first responders may be granted access to all or a portion of a structure 100. Similarly, card access readers and/or RFID readers may be configured to grant access to various portions of the structure 100 using a RFID tag or similar device that authenticates a person attempting to gain access to the various portions of the structure 100. The RFID reader may be configured to be compatible with RFID tags used by first responders (e.g., police, fire department, etc.).

The keypads, card access readers, and/or RFID readers may be further configured to emit one or more signals 250 that may indicate a breach, causing one or more events according to a predefined breach policy 245 to occur. For example, a teacher, security guard, or other personnel of a structure 100 may be provided with a predefined number sequence that may be used on one or more a keypads located throughout a structure 100. In the event that the predefined number sequence is entered on a keypad, a compartmentalization of the structure 100 may be initiated. Similarly, a predefined number sequence may be used to undo or cancel a compartmentalization. As can be appreciated, the keypads and/or RFID readers may be proximal to locations of doors, wherein the keypads and/or RFID readers are used to gain use of the doors to access one or more portions of the structure 100.

Monitoring devices 303 may comprise, for example, devices configured to receive, monitor, and/or transmit signals 250 and/or data from one or more security devices 207. For example, a monitoring device 303 may comprise a computing environment 203 (e.g., a server) that may monitor the signals 250 of the one or more security devices 207 in communication with the computing environment 203. In the event one or more of the security devices 207 indicates a breach of the structure 100, the computing environment 203 may conduct one or more events according to a predefined breach policy 245. In various embodiments, the monitoring device 303 may comprise circuitry capable of implementing a breach policy 245 without use of a processor.

Figure 3B:
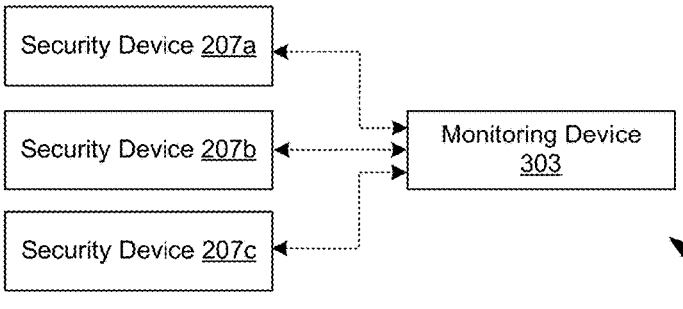
Figure 3C:
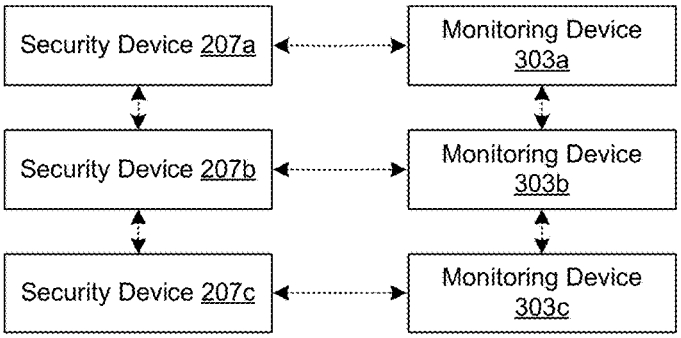

As shown in FIG. 3A, the security devices 207 and/or monitoring devices 303 may communicate in series over a network (e.g., low voltage network, wired network, wireless network, etc.). Alternatively, the security devices 207 and/or monitoring devices 303 may communicate in parallel, as shown in FIG. 3B. In FIG. 3C, each security device 207 may correspond to a monitoring device 303. For example, the security device 207*a* may correspond to the monitoring device 303*a*. As can be appreciated, structures 100 may include one or more networks 209 of fire-related devices (e.g., smoke detectors, fire alarms, lights, and/or sirens, etc.) used in the event a fire alarm is activated and/or smoke is detected. The security devices 207 and/or monitoring devices 303 may be configured to work on the existing network 209 of fire-related devices without interfering in the use of the fire-related devices. Alternatively, the security devices 207 and/or monitoring devices 303 may be configured to work on a network 209 independent of the network of fire-related devices (e.g., a dedicated security network).

Figure 4A:
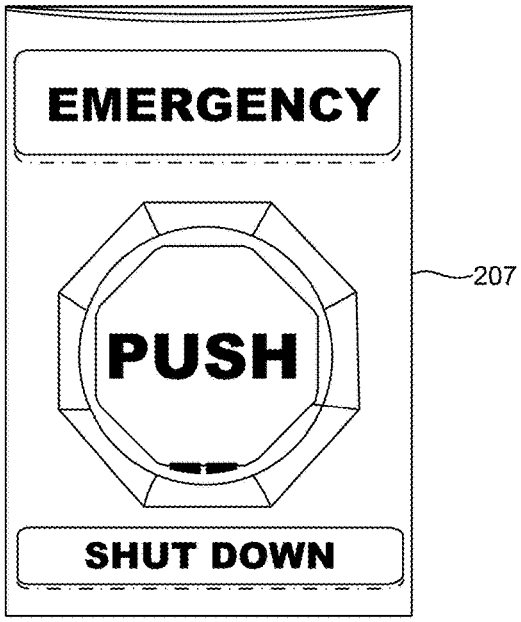
FIGS. 4A-4B are drawings of security devices in the form of wall-mounted duress alarms that may be used to start implementation of a breach policy according to various embodiments of the present disclosure.

Turning now to FIG. 4A, shown is an example security device 207 that includes, for example, a duress alarm that may be wall-mounted or mounted in another appropriate location. When pressed or otherwise manipulated, the duress alarm may start implementation of a predetermined breach policy 245. To this end, one or more security devices 207 (e.g., duress alarms) may be placed throughout a structure 100 that, when pressed, may cause a monitoring device 303 to close the doors in the automated door closing system, cause the light emitting devices to flash blue or other color lights, and/or activate sirens or other alarms. While the duress alarm may be used to start a breach policy 245, in various embodiments, the breach policy 245 may be initiated by another security device 207, such as a mobile computing device that has a mobile application executable on a client device 206 capable of communicating with other security devices 207 over the network 209. In various embodiments, a duress alarm may comprise a portable alarm (e.g., devices wearable by a teacher, a nurse, or other person in the structure 100) that may wirelessly communicate with the one or more monitoring devices 303.

Figure 4B:
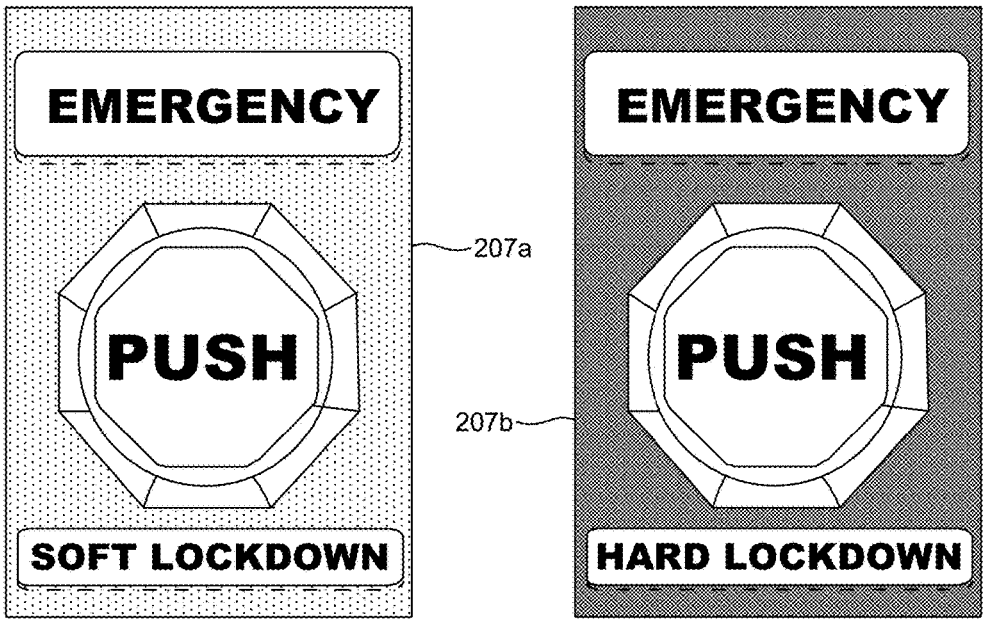

Referring next to FIG. 4B, shown is an example of a first security device 207*a* and a second security device 207*b* that include, for example, duress alarms made in a first color and a second color. In various embodiments, a first duress alarm and a second duress alarm may be placed in proximate or nearby positions, and, in some scenarios, placed proximate to a door or entry. The first duress alarm and the second duress alarm may be configured such that, when the first duress alarm is engaged, a "soft" lockdown occurs while a "hard" lockdown occurs when the second duress alarm is engaged. In other words, different breach policies 245 are employed, depending on which security device 207 is enabled (e.g., depending on which duress alarm is pressed or otherwise manipulated by personnel).

As different breach policies 245 may be applied, the different security devices 207 may be differentiated from each other in some manner (e.g., color, shape, size, location, label wording, etc.). For example, the duress alarms may be different colors that readily distinguish one from the other. In one embodiment, a yellow-colored duress alarm causes a soft lockdown when pressed while a blue-colored duress alarm causes a hard lockdown when pressed. Similarly, in another embodiment, a yellow-colored duress alarm causes a soft lockdown when pressed while a red-colored duress alarm causes a hard lockdown when pressed.

A soft lockdown will, in various embodiments, close and/or lock doors while no sirens, strobe lights, or notifications to emergency personnel are employed. A hard lockdown, on the other hand, may include closing and/or locking doors, triggering sirens or alarms, flashing strobe lights to flash, notifying emergency personnel over an appropriate communication channel, such as over a police frequency or over a telephone line (e.g., using a number for a police station or 9-1-1), or other appropriate action described herein. As may be appreciated, depending on a type of threat, a teacher, administrator, or other personnel can employ a different level of breach policy 245 by selecting a respective one of the duress alarms. While the embodiment of FIG. 4B depicts two duress alarms, in other embodiments, three or more duress alarms may be employed, each having a different color and causing a different level of breach policy 245 to be employed.

Figure 5A:
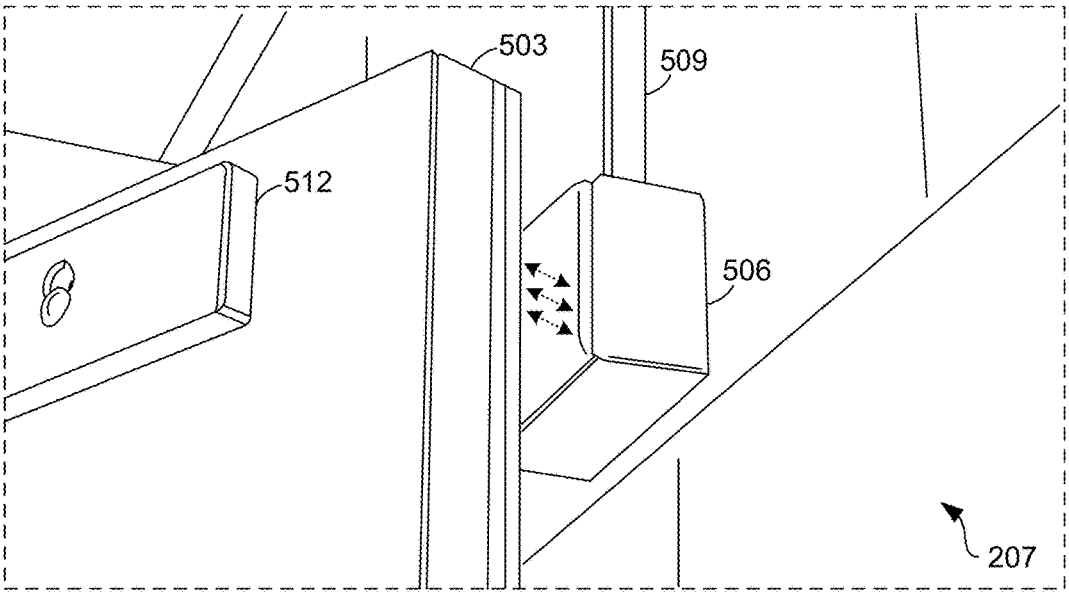
FIGS. 5A-5F are drawings of automated door closing mechanisms according to various embodiments of the present disclosure.

Moving on to FIG. 5A, shown is an embodiment of a security device 207, shown here by way of an example of an automated door closing mechanism. In the non-limiting example of FIG. 5A, a door 503 may be fixed in an open position, permitting access from a portion of a structure 100 to another portion of a structure 100. To fix the door 503 in the open position, an exterior door magnet on the exterior side of the door (not shown) may be coupled to an electronic structure magnet 506 located within the structure 100. The exterior door magnet and/or the structure magnet 506 may be communicatively coupled to the network 209 via a coupling 509, or like component. If the breach policy 245 designates that one or more doors are to be automatically closed upon an initiation of the breach policy 245, a signal may be communicated over the network 209 via the coupling 509 to the exterior door magnet and/or the structure magnet 506, causing the exterior door magnet to disengage the magnet, thereby causing a closing of the door. Accordingly, access to one or more portions of the structure 100 may be controlled by the network 209 of security devices 207. The door 503 may further include an interior door magnet 512, as will be discussed in greater detail below.

Figure 5B:
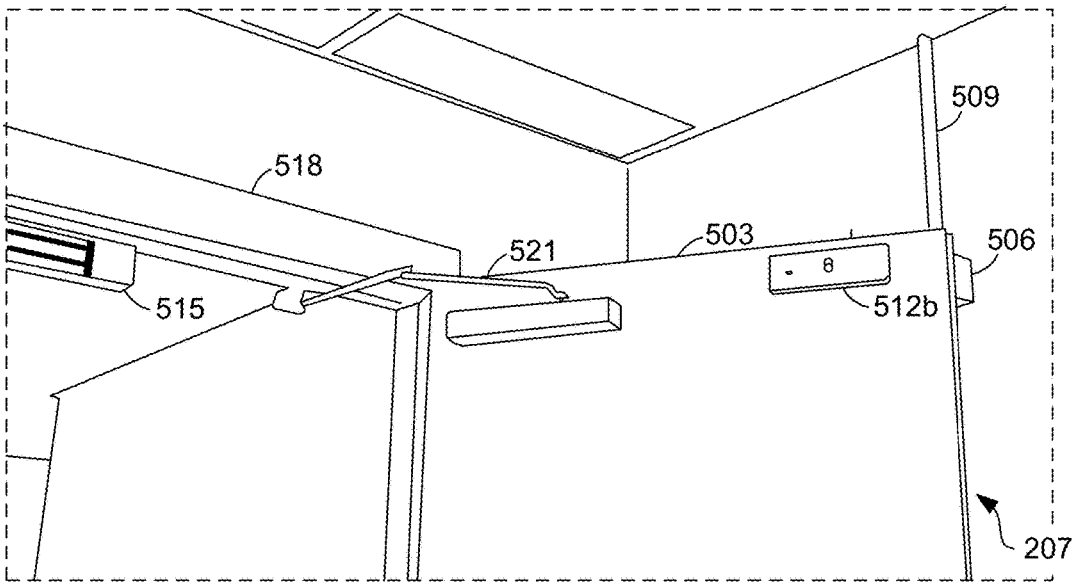

With reference to FIG. 5B, shown is another view of the automated door closing mechanism of FIG. 5A. As discussed above with respect to FIG. 5A, an exterior door magnet (not shown) may be coupled to a structure magnet 506 to fix a door in an open position. The automated door closing mechanism may further comprise an electronic frame magnet 515 fixed to the door frame 518 that may be coupled to the network 209. The automated door closing mechanism may be coupled to the network 209, for example, via wireless communication (e.g., Wi-Fi) or via wired communication (e.g., a phone line, a USB cable, an Ethernet cable, etc.). When the structure magnet 506 is disengaged upon an initiation of a breach policy 245, the frame magnet 515 may be engaged, creating a magnetic attraction between the frame magnet 515 and the interior door magnet 512 located on the interior of the door 503. A door arm 521 may facilitate the swinging motion of the door 503 from a first position (e.g., open) to a second position (e.g., closed).

Figure 5C:
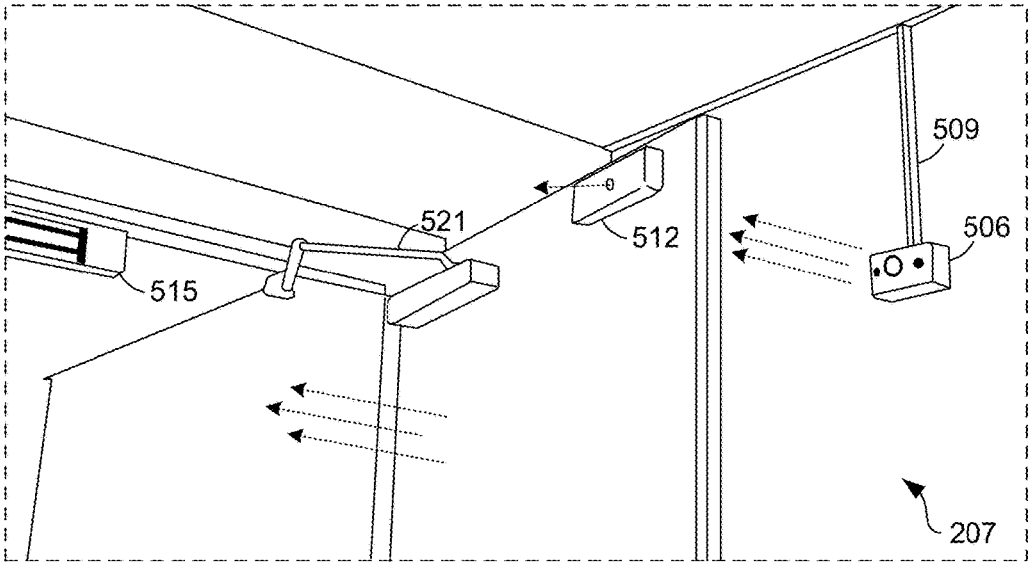

With reference to FIG. 5C, shown is another view of the automated door closing mechanism of FIGS. 5A-B. As discussed above with respect to FIG. 5B, an exterior door magnet (not shown) may be coupled to an electronic structure magnet 506 to fix a door in an open position. When the structure magnet 506 is disengaged upon an initiation of a breach policy 245, the frame magnet 515 may be engaged to create a magnetic attraction between the frame magnet 515 and an interior door magnet 512 located on the interior of the door 503. A door arm 521 may facilitate the swinging motion of the door 503 from a first position (e.g., open) to a second position (e.g., closed). The frame magnet 515 may remain engaged thereby keeping the door closed until an authorized user terminates the compartmentalization.

Figure 5D:
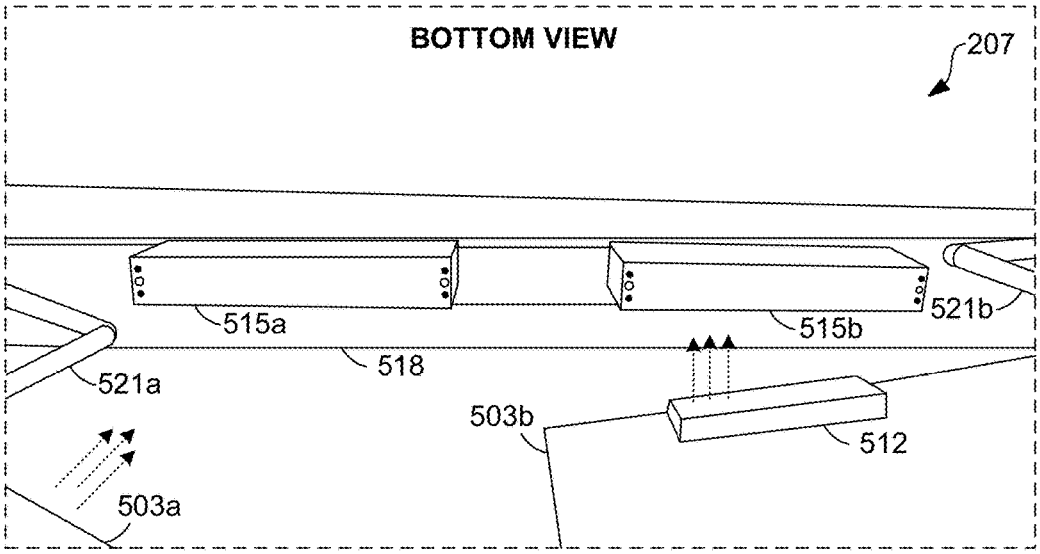

With reference to FIG. 5D, shown is a bottom view of the automated door closing mechanism of FIGS. 5A-C. As discussed above with respect to FIGS. 5B-C one or more frame magnets 515*a* and 515*b* may be engaged to create a magnetic attraction between the one or more frame magnets 515*a* and 515*b* and one or more interior door magnets 512*a* (not shown) and 512*b* located on the interior of the doors 503*a* and 503*b*. A door arm 521 may facilitate the swinging motion of the door 503 from a first position (e.g., open) to a second position (e.g., closed). The frame magnet 515 may remain engaged thereby keeping the door closed until an authorized user terminates the compartmentalization.

Figure 5E:
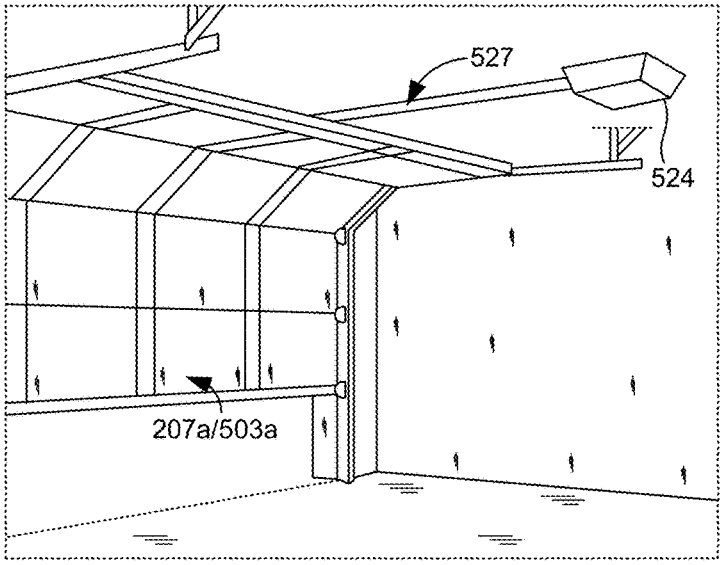
Figure 5F:
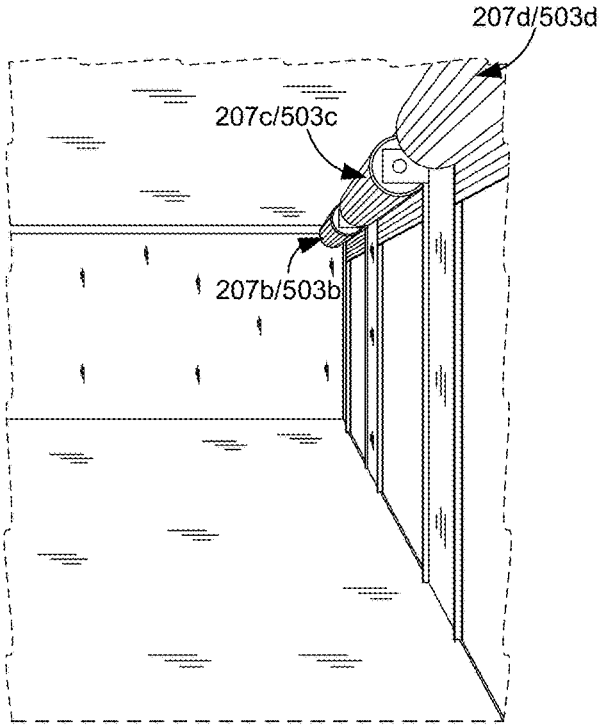

Turning now to FIGS. 5E and 5F, shown are other embodiments of security devices 207*a* . . . 207*d* that include doors 503*a* . . . 503*d* that may be controlled using an automated door mechanism. In the non-limiting examples of FIGS. 5E and 5F, a door 503 may include an overhead-mounted door that may be fixed in open or closed positions to control access to different areas of structure 100, such as a school or office building. To control the position of the door 503, an electronic control mechanism 524 may include one or more actuators, motors, or similar devices coupled to a lifting/lowering device 527 to raise or lower the door 503. To this end, the lifting/lowering device 527 may include a chain, pulley, or similar device to raise or lower the door 503 using an actuator, motor, or similar device. As may be appreciated, the electronic control mechanism 524 may raise or lower the door 503 as stipulated by an applicable breach policy 245.

For instance, if a breach policy 245 designates that the door 503 is to be automatically closed upon an initiation of the breach policy 245, a signal may be communicated over the network 209 to the electronic control mechanism 524 to lower the door 503, assuming the door 503 is not currently closed. Hence, access to one or more portions of the structure 100 may be controlled by the network 209 of security devices 207.

Figure 6:
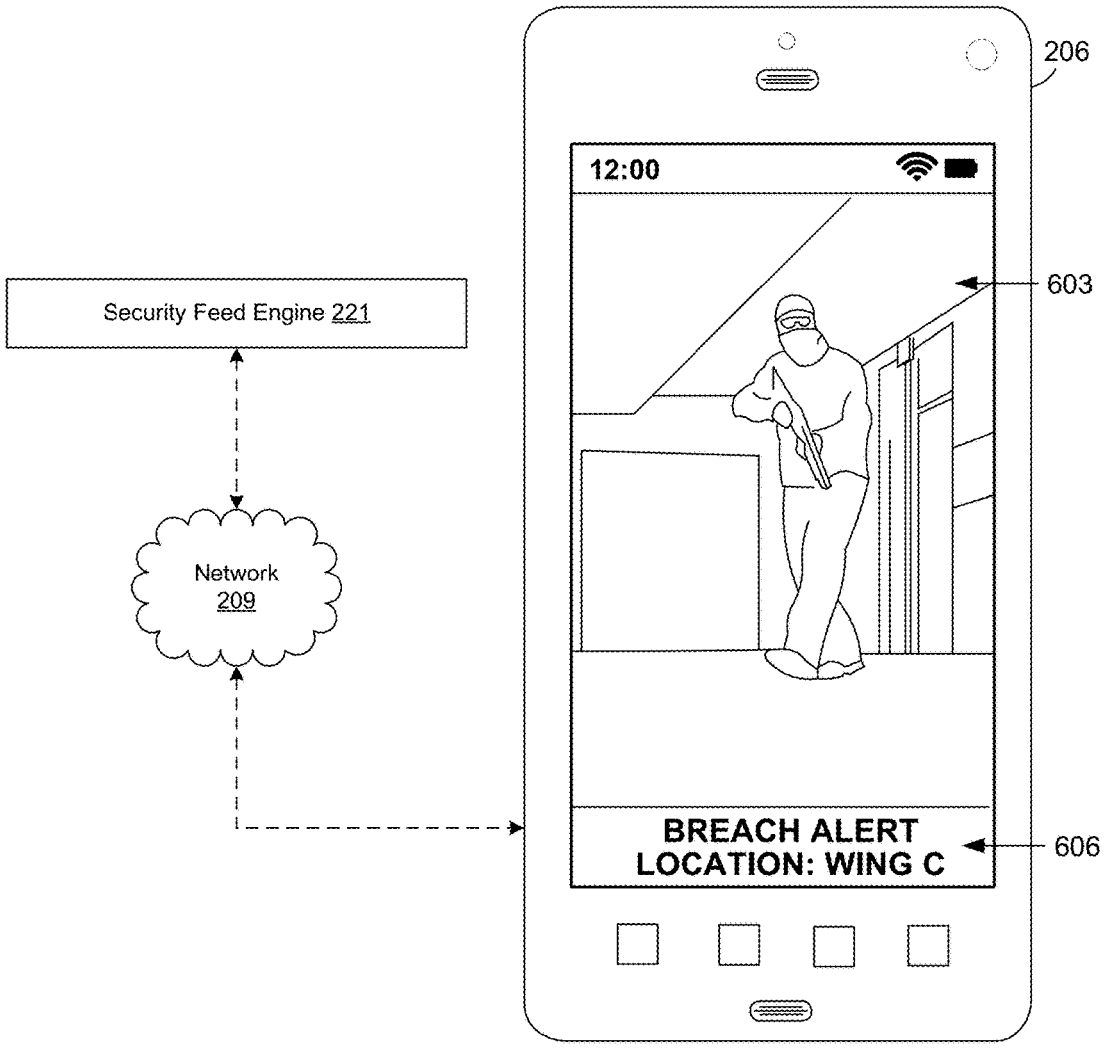
FIG. 6 is a drawing of a client device that may be used to access one or more feeds managed by a security monitoring system according to various embodiments of the present disclosure.

Moving on to FIG. 6, shown is an example of a client device 206 that may be used to access and/or receive various information in the event the breach policy 245 is initiated. For example, a client device 206 may comprise a mobile telephone (e.g., a smartphone) configured to receive feeds from one or more cameras acting as security devices 207 in a network 209. A feed may comprise, for example, a live feed 603 from one or more cameras as well as information 606 about a location of the feed. The live feed 603 may comprise an audio and/or video feed. According to various embodiments, the live feed 603 may be generated by the security feed engine 221 in the computing environment 203.

Figure 7:
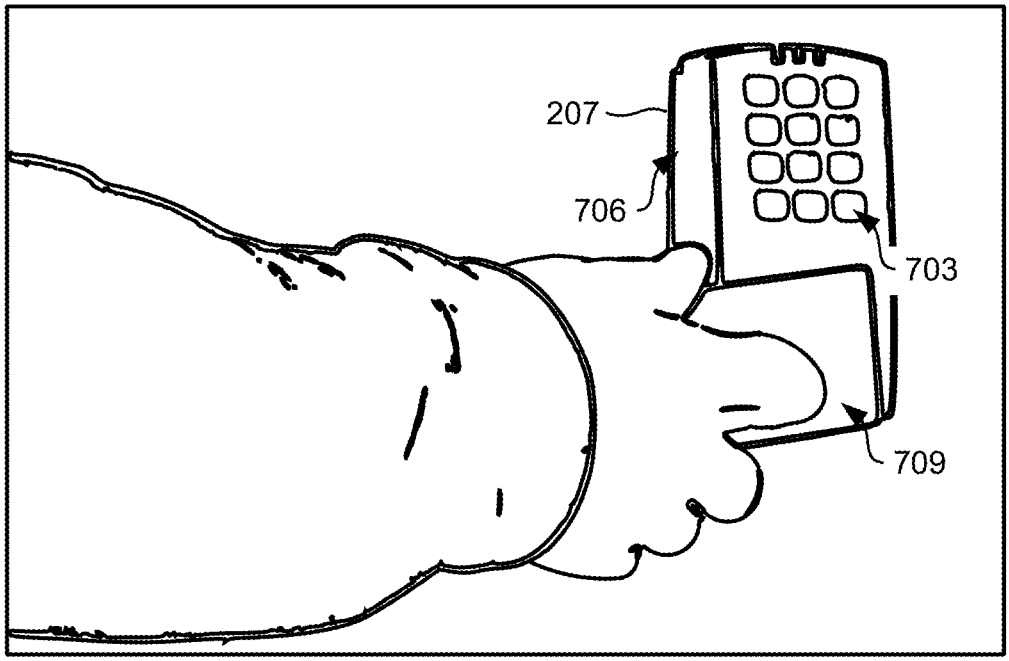
FIG. 7 is a drawing of another security device that may be used to initiate or disengage a breach policy according to various embodiments of the present disclosure.

Referring next to FIG. 7, shown is a non-limiting example of a security device 207 comprising both a keypad 703 and a card access reader 706. The keypad 703 may be configured to grant access to various portions of the structure 100 using a predefined number sequence that authenticates a person attempting to gain access to the various portions of the structure 100. For example, a predefined number sequence may be given to first responders. Upon entering the predefined number sequence on the keypad 703, the first responders may be granted access to all or a predefined portion of a structure 100 according to a breach policy 245. Similarly, card access readers 706 may be configured to grant access to various portions of the structure 100 using a security card 709 or similar component that authenticates a person attempting to gain access to the various portions of the structure 100. The card access reader 706 may further comprise an RFID reader compatible with RFID tags used by first responders (e.g., police, fire department, etc.).

The keypad 703 and the card access readers 706 may be implemented together or separately, and may be further configured to emit one or more signals that may indicate a breach, thereby causing one or more events according to a predefined breach policy 245 to occur. For example, a teacher, security guard, or other personnel of a structure 100 may be provided with a predefined number sequence that may be used on one or more a keypads located throughout a structure 100. In the event that the predefined number sequence is entered on a keypad, a compartmentalization of the structure 100 may be initiated. Similarly, a predefined number sequence may be used to undo or cancel a compartmentalization. As can be appreciated, the keypad 703 and/or the card access reader 706 may be positioned at locations close to doors, wherein the keypad 703 and/or the card access reader 706 are employed to gain use of the doors to access one or more portions of the structure 100.

In another embodiment, a first number sequence may be used to cause a first breach policy 245 while a second number sequence may be used to cause a second breach policy 245. For example, a first number sequence (e.g., 2-4-4-5) may cause a soft lockdown to occur while a second number sequence (e.g., 2-4-2-2-) causes a hard lockdown. To this end, different breach policies 245 are employed depending on which number sequence is provided on the keypad 703.

As noted above, in various embodiments, a soft lockdown may include closing and/or locking doors while no sirens, strobe lights, or notifications to emergency personnel are employed. A hard lockdown, on the other hand, may include closing and/or locking doors, triggering sirens or alarms, flashing strobe lights to flash, notifying emergency personnel over an appropriate communication channel, such as over a police frequency or over a telephone line (e.g., using a number for a police station or 9-1-1), or other appropriate action described herein.

Figure 8:
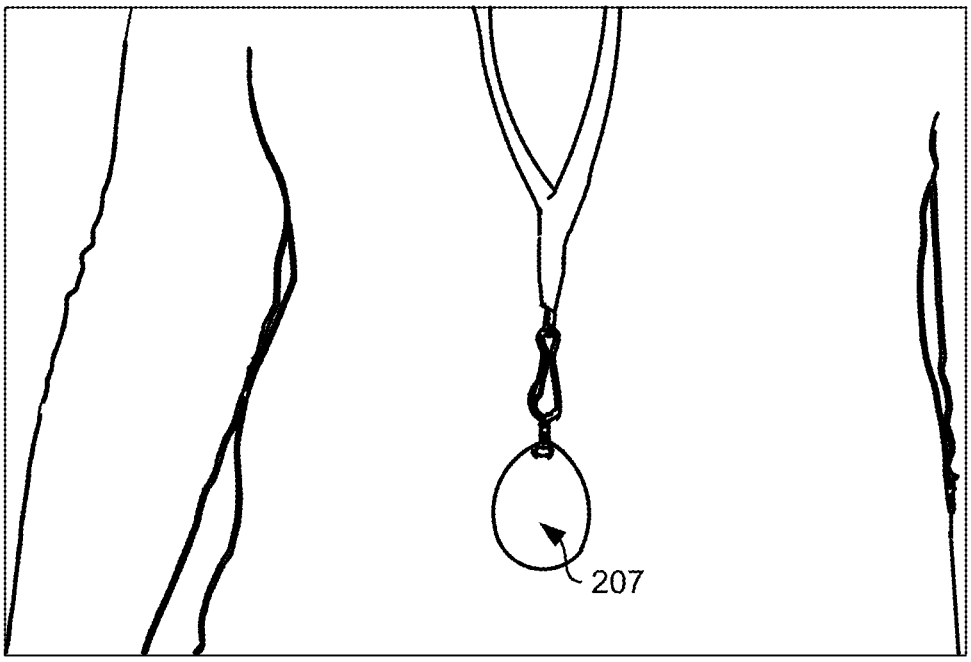
FIG. 8 is a drawing of yet another security device that may be used to initiate a breach policy according to various embodiments of the present disclosure.

Referring next to FIG. 8, shown is a non-limiting example of a wearable security device 207. According to various embodiments, the wearable security device 207 may comprise an RFID tag capable of authenticating personnel on an RFID reader, such as the RFID described above with respect to FIG. 7. According to various embodiments, the wearable security device 207 may comprise a transmitter, such as a transmitter capable of communication via radiofrequency (RF) transmitter, simple messaging service (SMS), GSM, Bluetooth, Zygbee, wireless fidelity (WiFi), etc. By engaging a button on the wearable security device 207, a signal may be sent the transmitter to a receiver within the network 209 that indicates a breach has occurred. As may be appreciated, the button may possibly be engaged accidently by the wearer. Accordingly, a low level of breach policy 245 may be initiated upon a detection of a signal emitted from the wearable security device 207.

Figure 9:
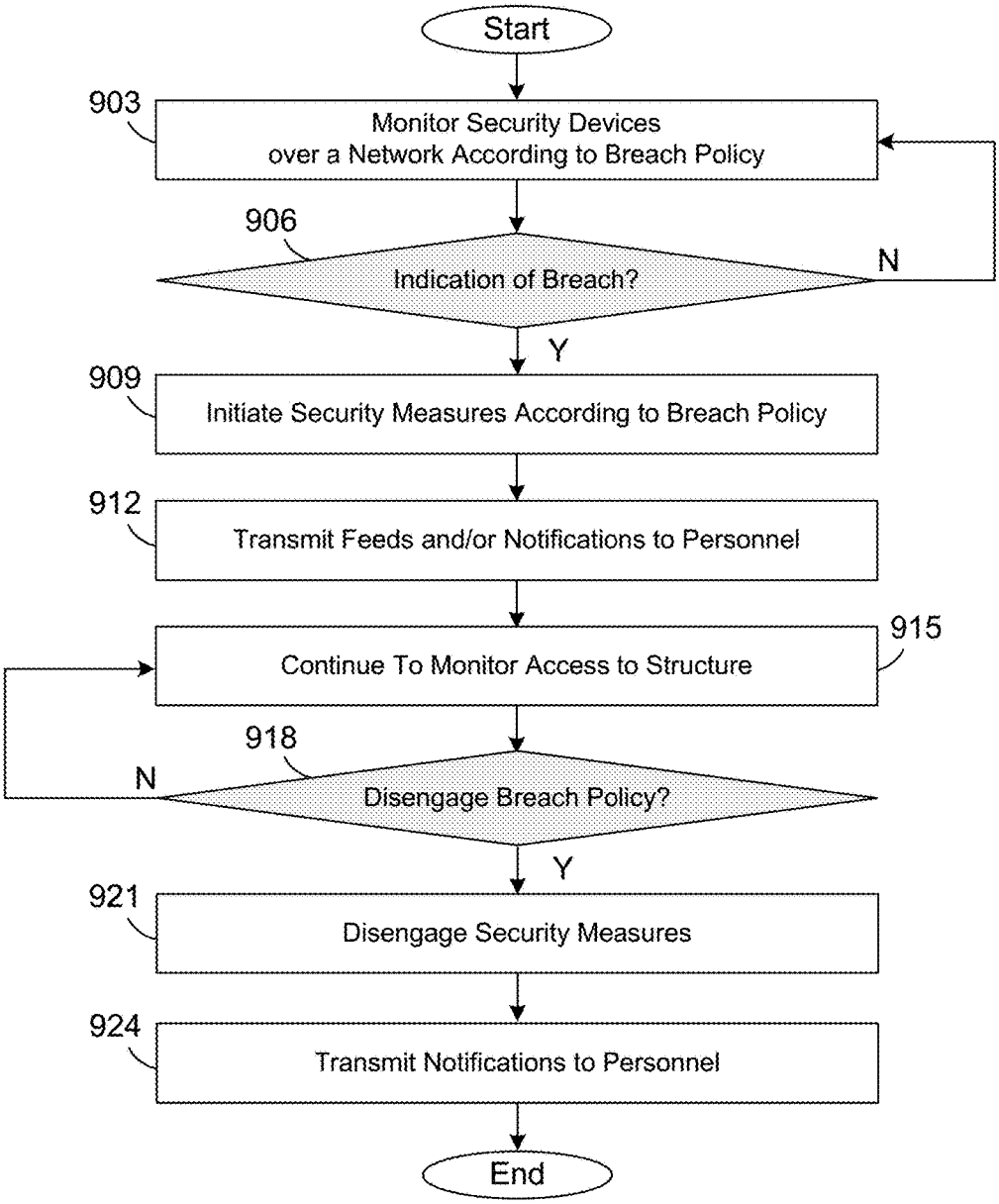
FIG. 9 is a flowchart illustrating one example of functionality implemented as portions of a security monitoring system executed in a computing environment in the networked environment of FIG. 2 according to various embodiments of the present disclosure.

Referring next to FIG. 9, shown is a flowchart that provides one example of the operation of a portion of an automated security system according to various embodiments. It is understood that the flowchart of FIG. 9 provides merely an example of the many different types of functional arrangements that may be employed to implement the operation of the portion of the automated security system as described herein.

Beginning with 903, one or more security devices 207 (e.g., cameras, noise emitting devices, light emitting devices, noise detection devices, automated door closing systems, door alarms, alarm buttons, telephones, access power controllers, keypads 703, RFID readers, etc.) comprising one or more sensors may be monitored over a network 209. Monitoring a security device 207 may include, for example, periodically or constantly monitoring a signal for each of a plurality of security devices 207 in the network 209 implemented in a structure 100 (e.g., via the computing environment 203 of FIG. 2). A security device 207 may comprise various sensors capable of detecting breaches and, in the event a sensor indicates a breach, send a signal over the network to other security devices 207 or to a monitoring device 303.

In 906, it is determined whether there is an indication of a breach communicated by the one or more security devices 207. If there is no indication of a breach, the network 209 and/or the automated security system may continue to monitor the security devices 207, as shown in 903. In the event an indication of a breach detected, in 909, breach events associated with a breach policy 245 may be initiated. For example, a breach policy 245 may indicate that doors controlling access from one portion of the structure 100 to another portion of the structure 100 are to be closed by employing an automated door closing mechanism to compartmentalize the structure 100 into one or more portions. Moreover, additional security measures associated with the breach policy 245 may be initiated. For example, a security company, a police department, a fire department, and/or any other personnel may be notified of the breach as well as information associated with the security devices 207 that indicated a breach has occurred.

According to various embodiments, a breach policy 245 may comprise one or more levels of breach events. Each of the levels may correspond to a priority that may indicate a threat level of the breach. To this end, the levels of breach events may correspond to a type of security device 207 indicating that a breach has occurred. For example, duress alarms may be placed throughout a school or government building. As can be appreciated, children may frequently engage a duress alarm as a prank or as an accident. A compartmentalization may not be necessary every time a child has engaged the duress alarm. Accordingly, a lower level of breach event may comprise sending a notification to administrative personnel that the duress alarm has been engaged as well as the location of the duress alarm. However, a noise detection device may not engage unless a noise has been emitted at a threshold level, such as that of a gunshot or an explosion. The noise detection device may be associated with a higher level of breach event such that the structure 100 is compartmentalized and emergency personnel are notified.

In 912, audio and/or video feeds generated by cameras acting as security devices 207 over the network 209 may be automatically made available to various personnel (e.g., first responders, teachers, administrators, etc.) via their client devices 206. While the structure 100 is being compartmentalized and personnel is being notified, the structure 100 may continue to be monitored, as shown in 915.

Next, in 918, it is determined whether to disengage a breach policy 245 and/or the events set forth by the breach policy 245. As described above, keypads 703, card access readers 706, and/or RFID readers may be placed throughout a structure 100 that are configured to grant access to various portions of the structure 100 using a predefined number sequence, an access card, or an RFID tag. To this end one or more of the breach events may be disengaged. As a non-limiting example, the strobe lights may continue to be engaged; however, the automated door closing system may be disengaged permitting emergency personnel to reach various zones 106 of the structure 100. If it is determined to not disengage the breach policy 245 and/or the events set forth by the breach policy 245, the structure 100 may continue to be monitored, as shown in 915.

Alternatively, if indicated to disengage the breach policy 245, in 921 the security measures set forth by the breach policy 245 (e.g., breach events) may be terminated or otherwise disengaged. Finally, in 924, various notifications may be sent to personnel such as teachers, administrators, emergency personnel, etc., that the breach policy 245 has been disengaged.

Figure 10:
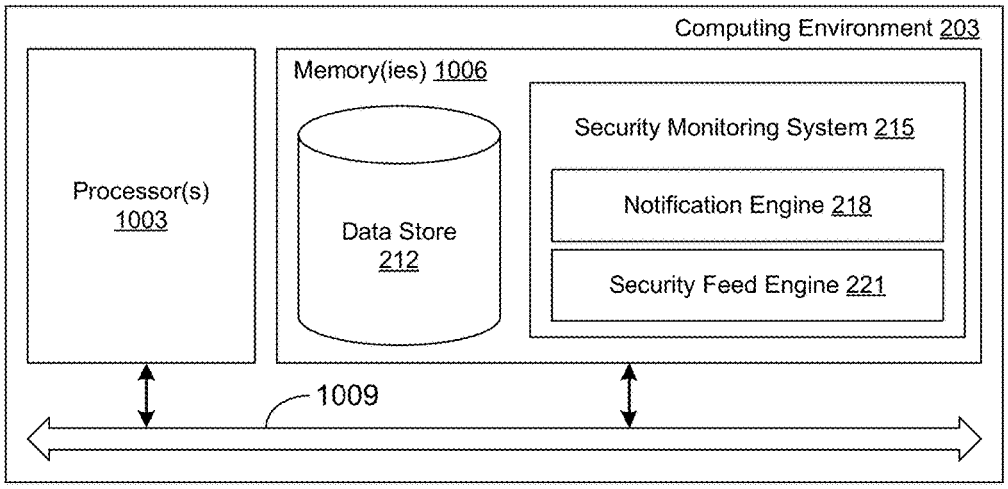
FIG. 10 is a schematic block diagram that provides one example illustration of a computing environment employed in the networked environment of FIG. 2 according to various embodiments of the present disclosure.

With reference to FIG. 10, shown is a schematic block diagram of the computing environment 203 according to an embodiment of the present disclosure. The computing environment 203 includes one or more computing devices. Each computing device includes at least one processor circuit, for example, having a processor 1003 and a memory 1006, both of which are coupled to a local interface 1009. To this end, each computing device may comprise, for example, at least one server computer or like device. The local interface 1009 may comprise, for example, a data bus with an accompanying address/control bus or other bus structure 100 as can be appreciated.

Stored in the memory 1006 are both data and several components that are executable by the processor 1003. In particular, stored in the memory 1006 and executable by the processor 1003 are a security monitoring system 215, a notification engine 218, a security feed engine 221, and potentially other applications. Also stored in the memory 1006 may be a data store 212 and other data. In addition, an operating system may be stored in the memory 1006 and executable by the processor 1003.

It is understood that there may be other applications that are stored in the memory 1006 and are executable by the processor 1003 as can be appreciated. Where any component discussed herein is implemented in the form of software, any one of a number of programming languages may be employed such as, for example, C, C++, C#, Objective C, Java®, JavaScript®, Perl, PHP, Visual Basic®, Python®, Ruby, Flash®, or other programming languages.

A number of software components are stored in the memory 1006 and are executable by the processor 1003. In this respect, the term "executable" means a program file that is in a form that can ultimately be run by the processor 1003. Examples of executable programs may be, for example, a compiled program that can be translated into machine code in a format that can be loaded into a random access portion of the memory 1006 and run by the processor 1003, source code that may be expressed in proper format such as object code that is capable of being loaded into a random access portion of the memory 1006 and executed by the processor 1003, or source code that may be interpreted by another executable program to generate instructions in a random access portion of the memory 1006 to be executed by the processor 1003, etc. An executable program may be stored in any portion or component of the memory 1006 including, for example, random access memory (RAM), read-only memory (ROM), hard drive, solid-state drive, USB flash drive, memory card, optical disc such as compact disc (CD) or digital versatile disc (DVD), floppy disk, magnetic tape, or other memory components.

The memory 1006 is defined herein as including both volatile and nonvolatile memory and data storage components. Volatile components are those that do not retain data values upon loss of power. Nonvolatile components are those that retain data upon a loss of power. Thus, the memory 1006 may comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

Also, the processor 1003 may represent multiple processors 1003 and/or multiple processor cores and the memory 1006 may represent multiple memories 1006 that operate in parallel processing circuits, respectively. In such a case, the local interface 1009 may be an appropriate network that facilitates communication between any two of the multiple processors 1003, between any processor 1003 and any of the memories 1006, or between any two of the memories 1006, etc. The local interface 1009 may comprise additional systems designed to coordinate this communication, including, for example, performing load balancing. The processor 1003 may be of electrical or of some other available construction.

Although the security monitoring system 215, the notification engine 218, the security feed engine 221, and other various systems described herein may be embodied in software or code executed by general purpose hardware as discussed above, as an alternative the same may also be embodied in dedicated hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits (ASICs) having appropriate logic gates, field-programmable gate arrays (FPGAs), or other components, etc. Such technologies are generally well known by those skilled in the art and, consequently, are not described in detail herein.

The flowchart of FIG. 9 shows the functionality and operation of an implementation of portions of the automated security system. If portions of the automated security system are embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor 1003 in a computer system or other system. The machine code may be converted from the source code, etc. If embodied in hardware, each block may represent a circuit or a number of interconnected circuits to implement the specified logical function(s).

Although the flowchart of FIG. 9 shows a specific order of execution, it is understood that the order of execution may differ from that which is depicted. For example, the order of execution of two or more blocks may be scrambled relative to the order shown. Also, two or more blocks shown in succession in FIG. 9 may be executed concurrently or with partial concurrence. Further, in some embodiments, one or more of the blocks shown in FIG. 9 may be skipped or omitted. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

Also, any logic or application described herein, including the security monitoring system 215, the notification engine 218, and/or the security feed engine 221, that comprises software or code can be embodied in any non-transitory computer-readable medium for use by or in connection with an instruction execution system such as, for example, a processor 1003 in a computer system or other system. In this sense, the logic may comprise, for example, statements including instructions and declarations that can be fetched from the computer-readable medium and executed by the instruction execution system. In the context of the present disclosure, a "computer-readable medium" can be any medium that can contain, store, or maintain the logic or application described herein for use by or in connection with the instruction execution system.

The computer-readable medium can comprise any one of many physical media such as, for example, magnetic, optical, or semiconductor media. More specific examples of a suitable computer-readable medium would include, but are not limited to, magnetic tapes, magnetic floppy diskettes, magnetic hard drives, memory cards, solid-state drives, USB flash drives, or optical discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A school security system, comprising:

a plurality of security devices in communication through a network implemented in a structure;

wherein at least a first one of the plurality of security devices comprises one of: a wall-mounted duress alarm, an electronic keypad, a radio-frequency identification (RFID) reader, a card access reader, a decibel meter, a smoke detector, a wearable security device, and a mobile computing device;

wherein a second one of the plurality of security devices comprises processing circuitry configured to:

identify a signal from the first one of the plurality of security devices indicative that a breach has occurred in a region of the structure; and in response to the signal from the first one of the plurality of security devices indicative that the breach has occurred being identified, automatically implement a predetermined breach policy comprising at least one of:

compartmentalizing the region of the structure by performing an automated closing or an automated locking of a door that separates the region of the structure from another region of the structure;

causing a light emitting device to emit a pulsating light;

causing a noise emitting device to emit a noise at a predefined decibel range; and notifying emergency personnel over an emergency channel;

identify a signal from a third one of the plurality of security devices indicative that the structure is safe; and in response to the signal from the third one of the plurality of security devices being indicative that the structure is safe, stop implementation of the predetermined breach policy by at least de-compartmentalizing the region of the structure using the door.

2. The school security system of claim 1, wherein:

the first one of the plurality of security devices is a first wall-mounted duress alarm;

the school security system further comprises a second wall-mounted duress alarm being a color different than the first wall-mounted duress alarm; and the processing circuitry is further configured to:

implement a first level of breach policy in response to the first wall-mounted duress alarm being pressed; and implement a second level of breach policy in response to the second wall-mounted duress alarm being pressed, the second level of breach policy being different than the first level of breach policy.

3. The school security system of claim 1, wherein the predetermined breach policy is selected from a plurality of potential breach policies based at least in part on a threat level determined in response to the signal from the first one of the plurality of security devices being identified.

4. The school security system of claim 3, wherein the threat level is determined according to a type of the first one of the plurality of security devices from which the signal is received.

5. The school security system of claim 1, wherein performing the automated closing of the door that separates the region of the structure from another region of the structure further comprises:

disengaging a first magnet through the network that causes the door, situated in an open position, to close; and engaging a second magnet through the network that causes the door to lock in a closed position.

6. The school security system of claim 1, wherein:

the door comprises an overhead-mounted door; and performing the automated closing of the door that separates the region of the structure from another region of the structure further comprises causing an actuator to lower the overhead-mounted door from an open position to a closed position.

7. The school security system of claim 1, wherein:

a third one of the plurality of security devices comprises an internet protocol (IP) camera; and the processing circuitry is further configured to broadcast a feed generated by the IP camera accessible by a client device over a wireless network.

8. The school security system of claim 1, wherein:

the first one of the plurality of security devices is the electronic keypad; and the processing circuitry is further configured to:

implement a first level of breach policy in response to a first number sequence being recognized as entered on the electronic keypad; and implement a second level of breach policy in response to a second number sequence being recognized as entered on the electronic keypad, the second level of breach policy being different than the first level of breach policy.

9. The school security system of claim 1, wherein the third one of the plurality of security devices comprises one of: an electronic keypad, a radio-frequency identification (RFID) reader, a card access reader, a wearable security device, a smoke detector, and a mobile computing device.

10. A method, comprising:

monitoring, by a computing device comprising processing circuitry, a plurality of security devices over a network implemented in a structure, wherein at least a first one of the plurality of security devices comprises one of: a wall-mounted duress alarm, an electronic keypad, a radio-frequency identification (RFID) reader, a card access reader, a decibel meter, a smoke detector, a wearable security device, and a mobile computing device;

identifying, by the computing device, a signal from the first one of the plurality of security devices indicative that a breach has occurred in a region of the structure; and in response to the signal from the first one of the plurality of security devices being identified, automatically implementing, by the computing device, a predetermined breach policy comprising at least one of:

compartmentalizing the region of the structure by performing an automated closing or an automated locking of a door that separates the region of the structure from another region of the structure;

causing a light emitting device to emit a pulsating light;

causing a noise emitting device to emit a noise at a predefined decibel range; and notifying emergency personnel over an emergency channel;

identifying, by the computing device, a signal from a third one of the plurality of security devices indicative that the structure is safe; and in response to the signal from the third one of the plurality of security devices being indicative that the structure is safe, stopping, by the computing device, an implementation of the predetermined breach policy by at least de-compartmentalizing the region of the structure using the door.

11. The method of claim 10, further comprising:

implementing, by the computing device, a first level of breach policy in response to a first wall-mounted duress alarm being pressed; or implementing, by the computing device, a second level of breach policy in response to a second wall-mounted duress alarm being pressed, wherein the second level of breach policy is different than the first level of breach policy and the first wall-mounted duress alarm is a color different than the second wall-mounted duress alarm.

12. The method of claim 10, wherein the predetermined breach policy is selected from a plurality of potential breach policies based at least in part on a threat level determined in response to the signal from the first one of the plurality of security devices being identified.

13. The method of claim 12, wherein the threat level is determined according to a type of the first one of the plurality of security devices from which the signal is received.

14. The method of claim 10, wherein performing the automated closing of the door that separates the region of the structure from another region of the structure further comprises:

disengaging, by the computing device, a first magnet through the network that causes the door, situated in an open position, to close; and engaging, by the computing device, a second magnet through the network that causes the door to lock in a closed position.

15. The method of claim 10, wherein:

the door comprises an overhead-mounted door; and performing the automated closing of the door that separates the region of the structure from another region of the structure further comprises causing, by the computing device, an actuator to lower the overhead-mounted door from an open position to a closed position.

16. The method of claim 10, further comprising broadcasting, by the computing device, a feed generated by a second one of the plurality of security devices that comprises an IP camera, wherein the feed as broadcasted is accessible by a client device over a wireless network.

17. The method of claim 10, wherein the first one of the plurality of security devices is the electronic keypad; and the method further comprises:

implementing, by the computing device, a first level of breach policy in response to a first number sequence being recognized as entered on the electronic keypad; or implementing, by the computing device, a second level of breach policy in response to a second number sequence being recognized as entered on the electronic keypad, the second level of breach policy being different than the first level of breach policy.

18. The method of claim 10, wherein the third one of the plurality of security devices comprises one of: an electronic keypad, a radio-frequency identification (RFID) reader, a card access reader, a smoke detector, a wireless security device, and a mobile computing device.

19. A security system for a structure, comprising:

a first security device, wherein the first security device is configured to generate a signal in response to a physical manipulation being performed on the first security device, the physical manipulation comprising one of: pressing a wall-mounted duress alarm, pressing a sequence on an electronic keypad, swiping a radio-frequency identification (RFID) reader with an RFID tag, swiping a card access reader with a card, pressing a button on a wireless key fob security device, and providing user input on a mobile computing device;

a second security device in communication with the first security device, wherein the second security device is configured to:

identify the signal generated by the first security device; and in response to the signal generated by the first security device being identified, implement a predetermined breach policy comprising at least one of:

compartmentalizing a region of the structure by performing an automated locking of a door that separates the region of the structure from another region of the structure;

causing a light emitting device to emit a pulsating light;

causing a noise emitting device to emit a noise at a predefined decibel range; and notifying emergency personnel over an emergency channel;

identify a signal from a third security device indicative that the structure is safe; and in response to the signal from the third security device indicative that the structure is safe being identified, stop implementation of the predetermined breach policy by at least de-compartmentalizing the region of the structure by unlocking the door.

20. The security system of claim 19, further comprising a fourth security device, the fourth security device comprising an internet protocol (IP) camera; and wherein the fourth security device is configured to broadcast a feed generated by the IP camera to become accessible to a client device over a wireless network.

* * * * *